US005189254A

United States Patent [19]

Berville et al.

[11] Patent Number: 5,189,254

[45] Date of Patent: Feb. 23, 1993

[54] SEALING BAND FOR AN ARROW-TYPE PROJECTILE

[75] Inventors: Marc Berville, Luty sur Arnon; Laurent Queille, Bourges, both of France

[73] Assignee: Giat Industries, Versailles, France

[21] Appl. No.: 744,471

[22] Filed: Aug. 12, 1991

[30] Foreign Application Priority Data

Aug. 13, 1990 [FR] France ..... 90 10285

[51] Int. Cl.[5] ..... F42B 14/02; F42B 14/06

[52] U.S. Cl. ..... 102/521; 102/439; 102/526

[58] Field of Search ..... 102/430, 439, 520–527, 102/703; 277/70, 79

[56] References Cited

U.S. PATENT DOCUMENTS

| | | | |
|---|---|---|---|
| H405 | 1/1988 | Covey | 102/520 |
| 3,131,938 | 5/1964 | Barry | 277/79 |
| 4,362,107 | 12/1982 | Romer et al. | 102/520 |
| 4,444,113 | 4/1984 | Campoli | 102/430 |
| 4,552,071 | 11/1985 | Horais et al. | 102/524 |
| 4,558,646 | 12/1985 | Hoffmann et al. | 102/527 |
| 4,608,927 | 9/1986 | Romer et al. | 102/521 |
| 4,671,182 | 6/1987 | Zierler et al. | 102/521 |
| 4,763,577 | 8/1988 | Romer et al. | 102/430 |
| 4,776,280 | 10/1988 | Burri et al. | 102/522 |

FOREIGN PATENT DOCUMENTS

| | | | |
|---|---|---|---|
| 268535 | 5/1988 | European Pat. Off. | 102/524 |
| 307307 | 3/1989 | European Pat. Off. | 102/430 |
| 1208596 | 2/1960 | France | 102/430 |
| 17267 | of 1912 | United Kingdom | 102/520 |

*Primary Examiner*—Harold J. Tudor

*Attorney, Agent, or Firm*—Bell, Seltzer, Park & Gibson

[57] ABSTRACT

The technical sector of the invention is that of sealing bands for arrow-type munitions.

The sealing band (5) according to the invention is arranged in an annular groove (9) of a sabot (2) of an arrow-type projectile, and is characterized in that it comprises a substantially annular rear zone (8) on which, when the band (5) is positioned in the groove, comes into contact a seal (6) joined to the sabot, and in that it comprises means (12, 13, 17) ensuring its mechanical joining, due to similarity of shape, with the material forming the seal (6).

Application to the field of large-caliber munitions.

4 Claims, 4 Drawing Sheets

SEALING BAND FOR AN ARROW-TYPE PROJECTILE

The field of the present invention is that of sealing bands for arrow-type projectiles.

An arrow-type projectile is composed in a known manner of a sub-calibre penetrator which is integral with a full-calibre sabot.

The sabot consists of several segments (generally three) which separate and release the penetrator at the muzzle of the barrel of the weapon under the action of aerodynamic forces.

Such projectiles pose problems when defining propellant gas seals.

In fact, it is necessary, on the one hand, to produce a seal between the barrel of the weapon and the projectile, this function being fulfilled by the band, and, on the other hand, between the various segments of the sabot, this function being fulfilled by an elastomer seal which is deposited on the sabot and which tears on separation of the segments.

The problem is then posed of the interface between the band and the seal itself.

In fact, it is always possible to see a crack appear on the band during pressure build-up in the barrel of the weapon, the only means of preventing a leak of gas between the projectile and the barrel then being to provide a seal at the rear of the band.

As can be seen from Patent EP0,049,329, it is possible to give the seal a slightly over-calibre bevelled peripheral profile which will come into contact with the barrel of the weapon and provide insulation vis-a-vis propellant gases of the rear portion of the band.

However, such an arrangement is unreliable since the bevelled portion is subject to considerable wear when in contact with the barrel of the weapon and leaks will then occur.

Patent DE2,537,116 describes a sub-calibre projectile whose sabot has a single-piece rear part. The latter provides both a seal against the gas and a support for the band. However, the fracture characteristics of such a sabot are difficult to control and such a solution cannot be transferred to arrow-type munitions having a rear seal made from elastomer.

Patent DE3,332,675 proposes provision of a seal which is attached at the level of a rear shoulder of the sabot, but such a configuration does not make it possible to prevent leakages of gas if the band should crack.

The latter document provides the possibility of producing the rear seal and the band in the form of a single piece, but such a solution is unsatisfactory since, with such a configuration, a crack at the level of the band will also immediately spread to the rear seal.

The invention aims to propose a band for an arrow-type projectile which makes it possible to avoid such drawbacks, and thus the subject of the invention is a sealing band for a sabot of an arrow-type projectile which is characterised in that it comprises, on the one hand, a substantially annular rear zone on which, when the band is positioned in an annular groove of the sabot, comes into contact a seal joined to the sabot and, on the other hand, means ensuring its mechanical joining, due to similarity of shape, with the material forming the seal.

A first advantage of such a configuration is that the seal, coming into contact with a rear annular zone of the band, will insulate this zone from the propellant gases and will provide a seal in the event of the band cracking.

A further advantage is that the means providing mechanical joining due to similarity of shape of the band with the material forming the seal will prevent the seal being torn away when the projectile travels in the barrel of the weapon.

According to a first embodiment, the joining means comprise recesses uniformly distributed over the periphery of the band and produced in a substantially radial direction of the latter and opening out at the level of the rear zone, the shape of these recesses being such that it has, from the rear zone, at least one narrowed zone followed by a widened zone.

Thus, the recesses may be substantially cylindrical holes whose axis is arranged at a distance from the rear zone which is less than their radius.

According to a second embodiment, the joining means comprise substantially cylindrical bores uniformly distributed and opening out at the level of the rear zone, the axis of these bores being inclined relative to that of the band and, advantageously, intersecting the axis of the band in front of the rear zone relative to the projectile.

According to a third embodiment, the band comprises at the level of the rear zone a substantially cylindrical extension which is coaxial thereto and the joining means comprise bores made on the extension in a substantially radial direction and uniformly distributed over at least a circumference of the extension.

According to an alternative embodiment, the cylindrical extension comprises an incipient fracture arranged at the rear of the bores, which may consist of a narrowed zone of the extension on which are made holes in a substantially radial direction and uniformly distributed over a circumference.

The band according t this third embodiment is particularly suited to carry, on its cylindrical extension, a ring intended to join the projectile to a sleeve, in this case, the bores opening out between the annular zone of the band and the ring and the seal filling the space located between the ring and the annular zone.

The invention will be better understood on reading the description of particular embodiments, which description is made with reference to the appended drawings, in which.

Figure 1:
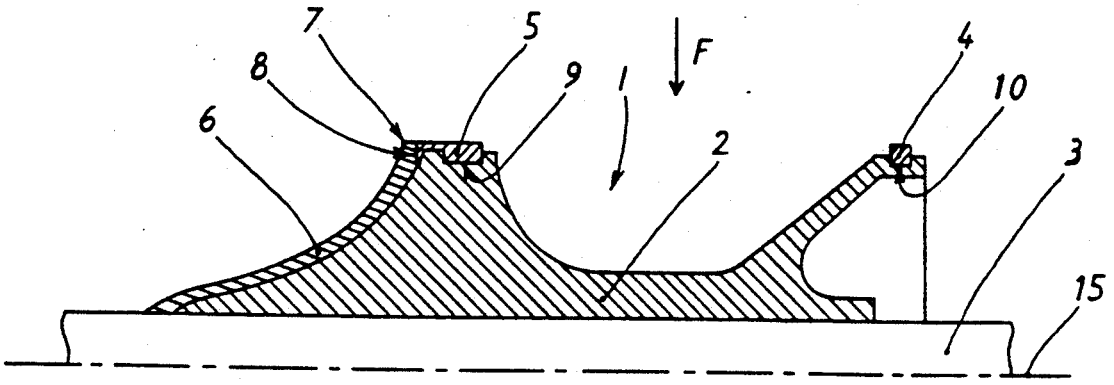
FIG. 1 shows diagrammatically in half-view an arrow-type projectile equipped with a band according to a first embodiment.
Figure 2:
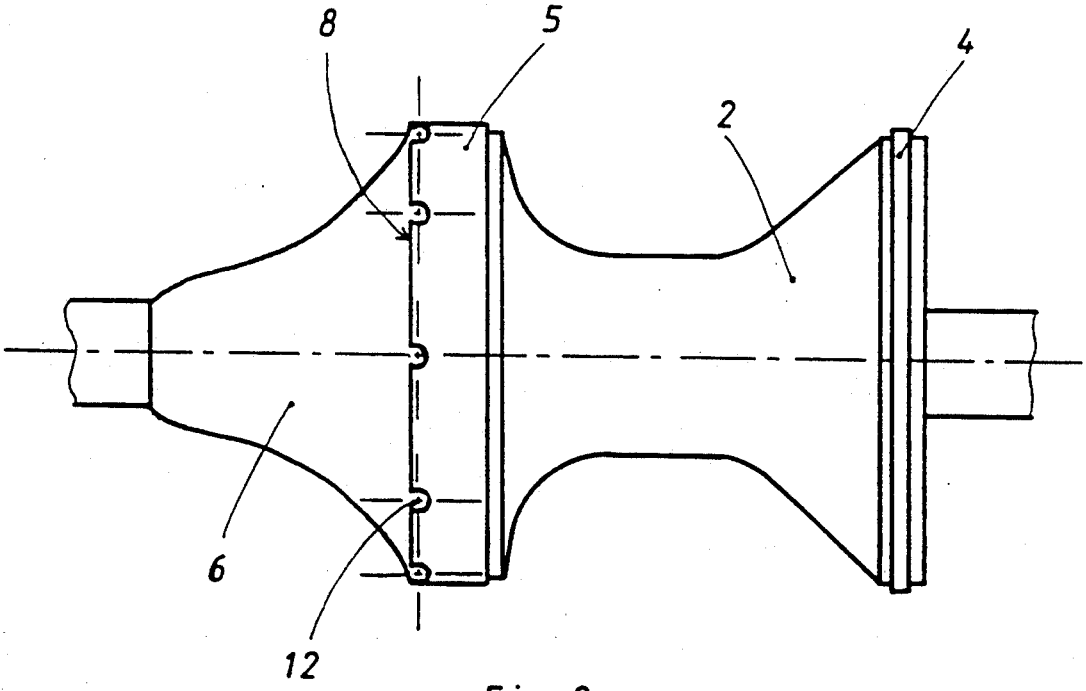
FIG. 2 is a view of the above according to the direction F.

Referring to FIG. 1, an arrow-type projectile 1 is formed in a conventional manner by a sabot 2, comprising several, generally three, segments, and in which is arranged a penetrator 3 made of a heavy material, for example depleted uranium.

The various segments of the sabot are held by a front hoop 4 and a band 5 which is intended to form a seal between the barrel of the weapon and the projectile on firing.

Front hoop and band are arranged in annular grooves 9 and 10 made on the sabot and have the calibre of the casing, their positioning being effected by means of injection directly on the sabot arranged in a suitable mould.

A rear seal 6 provides the seal between the planes of the joins of the segments of the sabot and between the sabot and the penetrator.

This seal is, for example, obtained by injecting an elastomer (such as a polymer which can be vulcanised at high temperature) on the assembled sabot arranged in a suitable mould.

The seal comprises an outer lip 7 which is slightly over-calibre (of the order 121 mm for a 120 mm calibre), and it comes into contact with the band 5 at the level of a rear annular zone 8 of the latter.

The seal 6 could, if appropriate, not have a lip, but in this case, the outer diameter of the seal will, nevertheless, be close to the outer diameter of the band and thus for this reason greater than the calibre of the barrel of the weapon. The outer portion of the seal will thus be in contact with the inner surface of the barrel of the weapon.

Contact of the seal at the level of the annular zone 8 makes it possible to prevent any leakage of propellant gases between the seal and the band and also prevents leakages from spreading between the barrel of the weapon and the band if the latter were to crack.

Figure 3A:
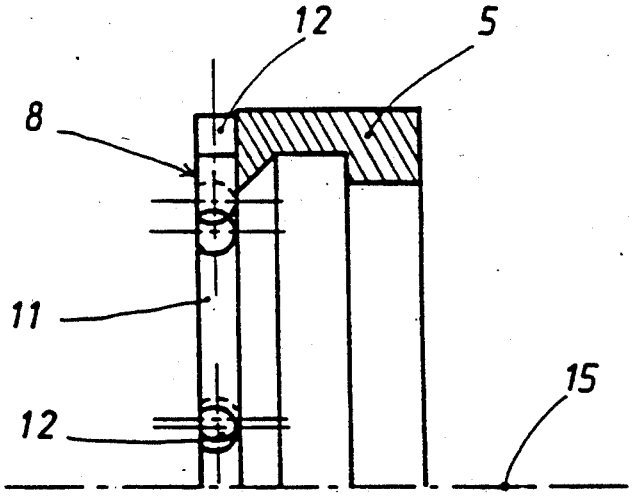
FIGS. 3A, 3B and 3C are views of the band on its own.
Figure 3B:
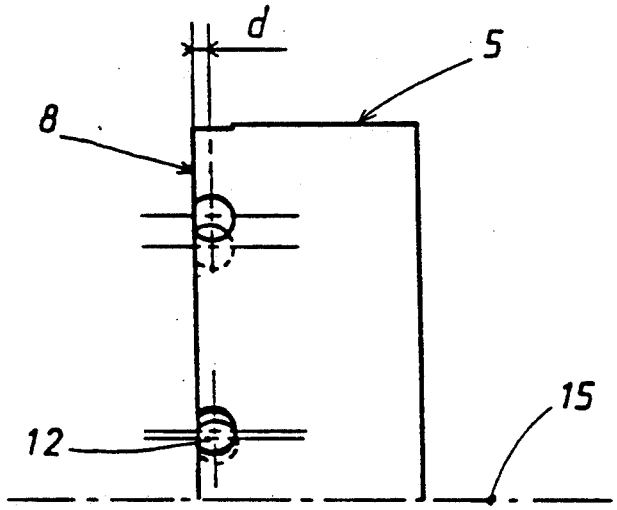
Figure 3C:
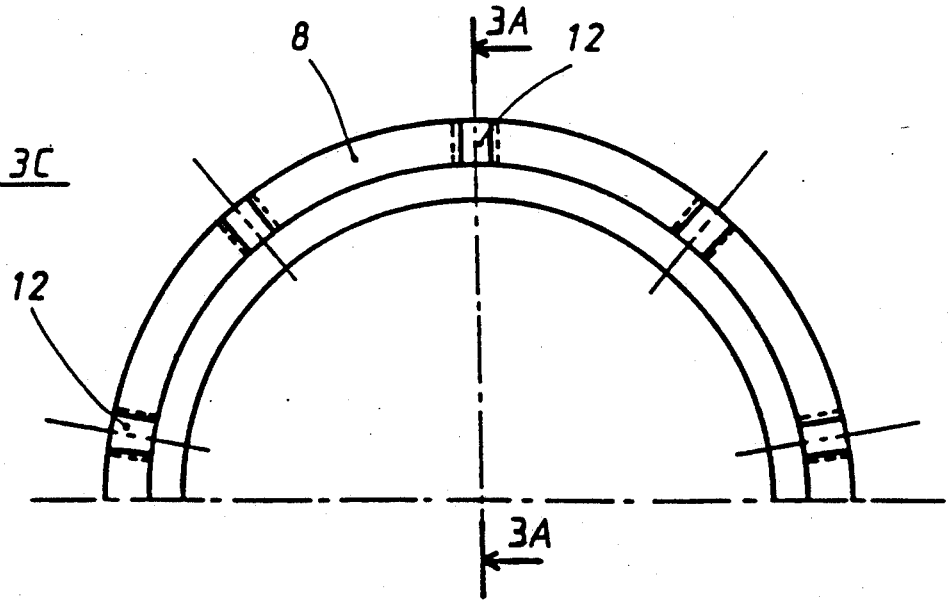

Referring to FIGS. 3A, 3B and 3C, which show the band 5 on its own, in greater detail, it can be seen that the annular zone 8 is carried by an annular collar 11 and comprises recesses 12 uniformly distributed over its periphery.

These recesses are cylindrical holes 12 made in a substantially radial direction of the band and which pass through the collar 11. The band, in this case, comprises nine uniformly distributed holes 12.

The number of holes chosen will preferably be a multiple of the number of segments of the sabot and uniform distribution will be understood to mean a distribution ensuring a position of the centre of gravity of the band substantially on its axis 15 (axis of the projectile).

A substantially equal spacing between each hole and its two immediate neighbours may thus be adopted (as is the case in the examples shown).

However, it will also be possible to adopt a distribution of the holes such that the band has a rotational symmetry of the order of 3 (for a sabot with three segments) about its axis.

The axis of these holes is arranged at a distance d (FIG. 3B) which is less than the radius of the holes and thus the holes open out at the level of the rear annular zone 8.

Such an arrangement makes it possible to obtain recesses which have, from the rear zone 8, at least one narrowed zone (in this case the opening of the holes on the rear zone 8) followed by a widened zone (the diameter of the holes).

Thus, the material making up the seal will, on injection, penetrate into the recesses, and the narrowing of the latter will permit mechanical retention of the seal.

The recesses thus constitute a means ensuring mechanical joining due to similarity of shape of the band with the material making up the seal.

In this manner, the seal is prevented from separating from the band following friction thereof or friction of its peripheral lip 7 on the barrel of the weapon.

Figure 4:
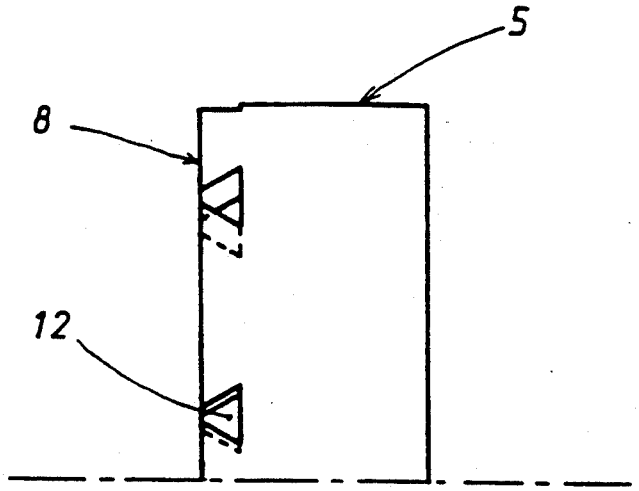
FIG. 4 shows an alternative embodiment of the above embodiment.

FIG. 4 shows, in a non-sectioned external view, an alternative embodiment in which the recesses 12 which are made on the collar in a radial direction have a trapezoidal cross-section.

Figure 5A:
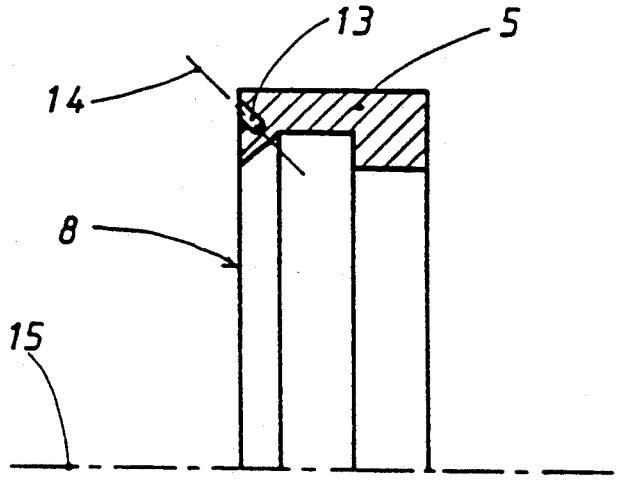
FIGS. 5A and 5B show the band on its own according to a second embodiment of the invention.
Figure 5B:
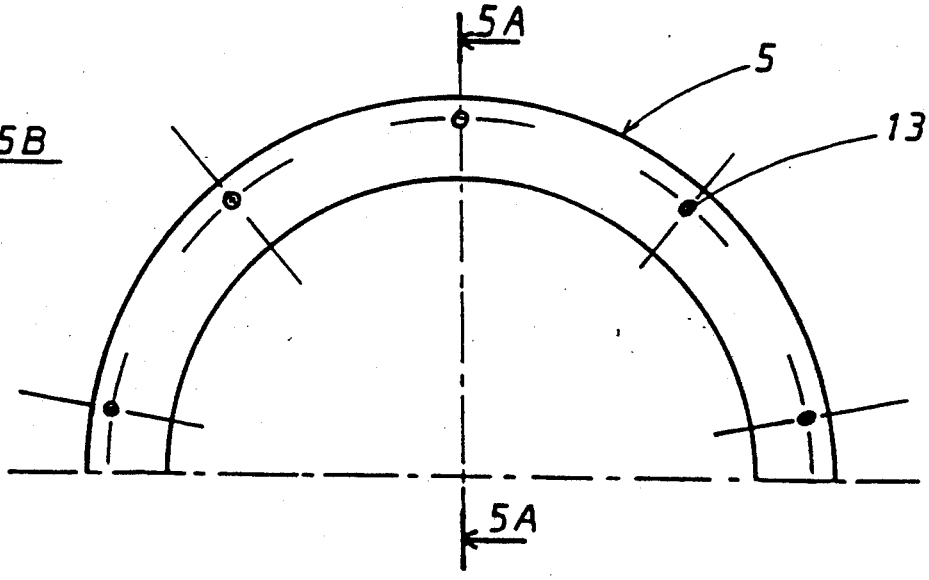

FIGS. 5A and 5B show a second embodiment of the invention in which the band 5 carries, at the level of the annular zone 8, substantially cylindrical bores 13 which are uniformly distributed (in this case nine bores).

The axes 14 of these bores are inclined relative to the axis 15 of the band 5 (and thus to the axis of the projectile).

In the alternative embodiment shown, the axes 14 are inclined such that they intersect the axis of the band in front of the annular zone 8.

Such an arrangement makes it possible to distance the base of the bores from the outer surface of the band, which improves the mechanical behaviour of the latter when in contact with the barrel of the weapon.

During manufacture, the material of the seal will penetrate into these bores which will form a means of joining the seal and the band, the strength of this means being ensured by the inclination of the axes of the bores.

Figure 6:
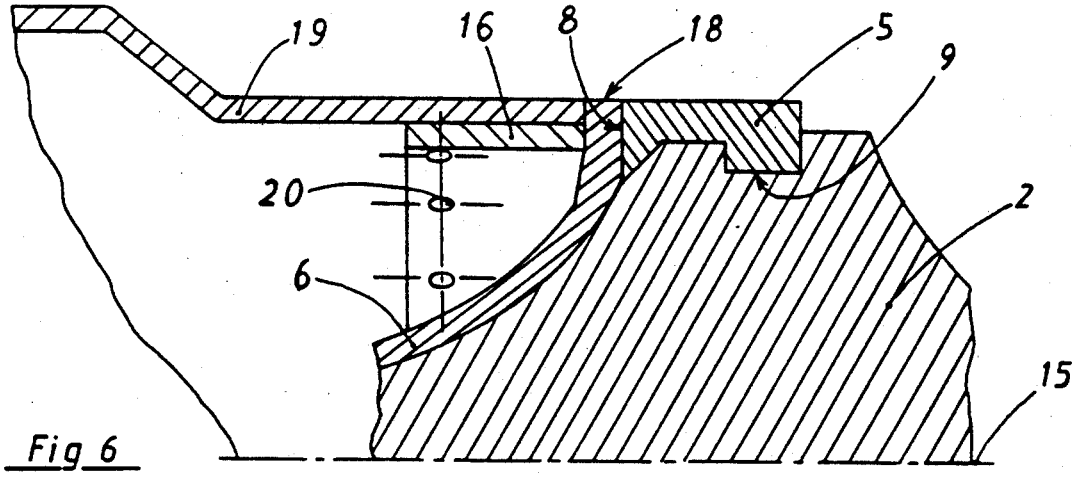
FIG. 6 shows diagrammatically an arrow-type projectile equipped with a band according to a third embodiment.
Figure 7:
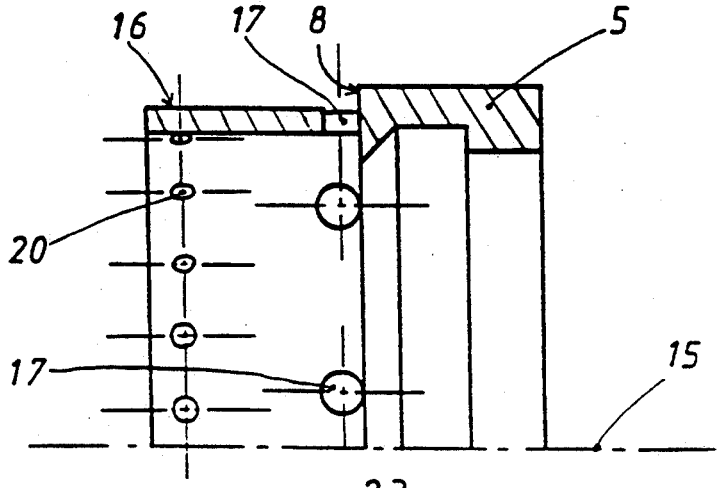
FIG. 7 is a view of the band in FIG. 6 shown on its own.

FIG. 6 shows a third embodiment in which the band comprises, at the level of the rear zone 8, a cylindrical extension 16 which is coaxial therewith and has a subcalibre diameter.

This extension carries bores 17, which are uniformly distributed, made over a circumference of the extension in a substantially radial direction and in the vicinity of the annular rear zone 8.

In the particular embodiment described here, the bores are cylindrical and tangential to the annular zone 8, but any other form could be envisaged.

On producing the seal 6, the material of the latter will penetrate into the bores and form a crown 18 surrounding the extension 16.

The bores thus form the means for joining the band and the seal.

The extension 16 may advantageously be used to fix to the projectile a linking ring 19 which will make it possible to join the assembled projectile with a sleeve containing the propulsive charge (not shown here). Such a ring is described in Patent Application FR 2,620,214.

It is joined to the projectile by means of a first fixing means, which is not shown here, which will, for example, be rivets arranged in holes 20 uniformly distributed over a circumference of the extension and located opposite other holes carried by the ring 19.

The ring is fixed on the sleeve by a second fixing means of the type described in Patent Application FR 2,620,214 (for example, rivets and an intermediate piece).

The fixing means will be of a size such that the fracture of the second means occurs under the effect of the pressure of the propellant gases, the first means not fracturing.

The bores 17 will also be of a size such that the fracture of the extension 16 occurs, if appropriate, preferably at the level of the holes 20 and of the first means for fixing the ring 19.

It will, for example, be possible to provide more holes 20 than bores 17 for a single diameter, the section to be sheared thus being more brittle at the level of the holes 20.

It will also be possible to make the fixing rivets arranged in the holes 20 brittle or, alternatively, to reduce the thickness of the extension 16 at the level of the holes 20.

With this latter embodiment of the invention, it will be particularly advantageous to position the ring 19 such that it comes into contact with the crown 18 formed by the seal 6.

Thus, the seal fills the entire space located between the ring 19 and the annular zone 8 of the band and is clamped between these two elements so that it acts as a damper for the vibrations transmitted by the sleeve to the projectile by means of the ring, thus reducing the mechanical stresses at the level of the ring/projectile link and increasing the strength and service life of this link.

Figure 8:
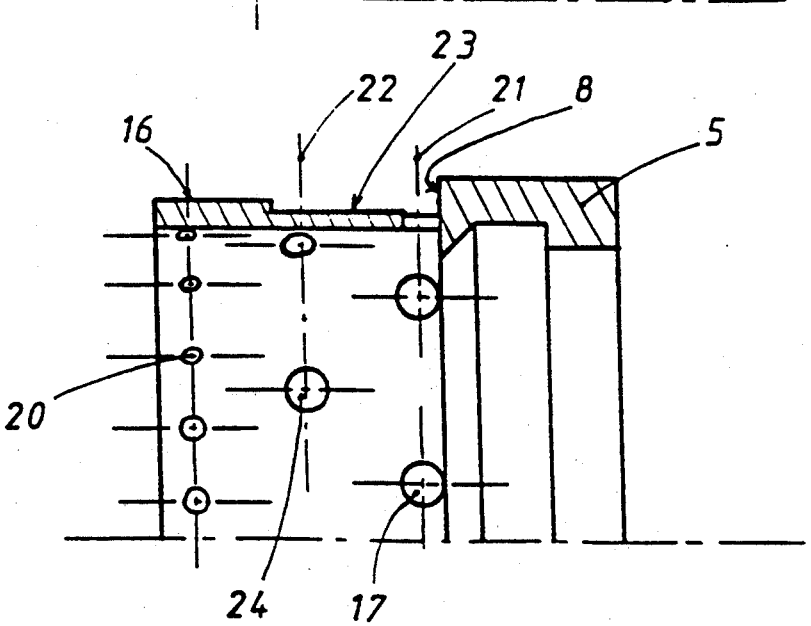
FIG. 8 is an alternative embodiment of this third embodiment of the band.

FIG. 8 shows an alternative embodiment in which the bores 17 are distributed over a circumference located in a radial plane 21.

Holes 24 are distributed over a circumference located in another radial plane 22.

The extension 16 also has a narrowed zone 23 at the level of the bores 17 and of the holes 24.

The material making up the seal 6 penetrates only into the bores 17 located in the plane 21, the holes 24 located in the plane 22 being free.

The narrowed zone 23 forms an incipient fracture permitting separation of the band 5 from the ring 19.

The fracture will occur at the level of the plane 22 in which the holes 24, which are not filled by the material of the seal, are located, that is to say at the rear of the bores 17 which will continue to fulfill their function of joining the seal and the band.

A reduced length for the extension 16 is thereby obtained, while ensuring joining of the seal 6 and of the band.

Other embodiments of the incipient fracture of the extension to the rear of the bores 17 may be adopted, and it will be possible, for example, to provide an annular channel forming a narrowing of the extension.

We claim:

1. An arrow-type projectile comprising a penetrator, a sabot formed by several segments disposed around said penetrator, a sealing band positioned in an annular groove of the sabot, an annular rear seal provided on a rear part of the sabot, and joining means provided between said rear seal and an annular rear zone of said sealing band for establishing a mechanical connection between said sealing band and said rear seal, wherein at the level of said annular rear zone of said sealing band, there is provided a substantially cylindrical extension coaxial with said sealing band, said joining means comprising bores made on said extension in a substantially radial direction and uniformly distributed over at least a circumference of said extension, said bores being filled by the material constituting said rear seal.

2. An arrow-type projectile according to claim 1, wherein said cylindrical extension comprises an incipient fracture arranged at the rear of the bores.

3. An arrow-type projectile according to claim 2, wherein said incipient fracture is formed by a narrowed zone of said extension on which are made holes in a substantially radial direction and uniformly distributed over a circumference.

4. In an arrow-type projectile according to claim 1, wherein said extension carries a ring intended to join said projectile to a sleeve, said bores opening out in an annular space defined between a forward end of said ring and said rear zone of said sealing band, said space being filled up by the material constituting said rear seal.

* * * * *